US011738371B2

(12) United States Patent
Dollinger

(10) Patent No.: US 11,738,371 B2
(45) Date of Patent: Aug. 29, 2023

(54) SYSTEM AND METHOD FOR POLISHING CAPSULES

(71) Applicant: PHARMA TECHNOLOGY SA, Thines (BE)

(72) Inventor: Martial Dollinger, Braine l'Alleud (BE)

(73) Assignee: PHARMA TECHNOLOGY SA, Thines (BE)

( * ) Notice: Subject to any disclaimer, the term of this patent is extended or adjusted under 35 U.S.C. 154(b) by 649 days.

(21) Appl. No.: 16/964,153

(22) PCT Filed: Feb. 21, 2018

(86) PCT No.: PCT/EP2018/054277

§ 371 (c)(1),
(2) Date: Jul. 22, 2020

(87) PCT Pub. No.: WO2019/161893

PCT Pub. Date: Aug. 29, 2019

(65) Prior Publication Data

US 2021/0031241 A1 Feb. 4, 2021

(51) Int. Cl.

| | |
|---|---|
| ***A61J 3/07*** | (2006.01) |
| ***B08B 1/00*** | (2006.01) |
| ***A46B 13/02*** | (2006.01) |
| ***B08B 13/00*** | (2006.01) |

(52) U.S. Cl.

CPC ..... *B08B 1/002* (2013.01); *A46B 13/02* (2013.01); *A61J 3/074* (2013.01); *A61J 3/077* (2013.01); *B08B 13/00* (2013.01); *A46B 2200/3073* (2013.01); *A46B 2200/3086* (2013.01)

(58) Field of Classification Search

CPC ..... B08B 1/002; B08B 13/00; A46B 13/02; A46B 2200/3073; A46B 2200/3086; A46B 13/006; A46B 9/028; A61J 3/074; A61J 3/077; A61J 3/10

See application file for complete search history.

(56) References Cited

U.S. PATENT DOCUMENTS

| | | | | |
|---|---|---|---|---|
| 2,918,691 | A | 12/1959 | Lake | |
| 2019/0367201 | A1* | 12/2019 | Jeschke | G01N 27/24 |

FOREIGN PATENT DOCUMENTS

| | | | |
|---|---|---|---|
| CN | 203710388 | U | 7/2014 |
| CN | 203863484 | U * | 10/2014 |
| CN | 204868498 | U * | 12/2015 |
| CN | 205021384 | U | 2/2016 |

(Continued)

OTHER PUBLICATIONS

Machine translation of CN-204868498-U (Year: 2015).*

(Continued)

*Primary Examiner* — Erin F Bergner
(74) *Attorney, Agent, or Firm* — Christensen O'Connor Johnson Kindness PLLC

(57) ABSTRACT

A system for polishing capsules includes a brush located at least partially inside a wall arranged around an axis (Z). The brush has bristles arranged around the axis (Z) to form a helical conveying ramp for the capsules. The lengths of the bristles of the brush are distinct and a protrusion is mechanically coupled to the wall to bend at least some of the bristles of the brush when the latter is in rotational movement around the axis (Z).

15 Claims, 8 Drawing Sheets

(56) References Cited

FOREIGN PATENT DOCUMENTS

| | | | |
|---|---|---|---|
| CN | 205817548 | U | 12/2016 |
| CN | 107498441 | A | 12/2017 |
| GB | 1 218 900 | | 1/1971 |
| JP | S63272709 | A | 11/1988 |
| KR | 20140131234 | A | 11/2014 |

OTHER PUBLICATIONS

Machine translation of CN-203863484-U (Year: 2014).*
International Search Report dated Oct. 29, 2018, issued in corresponding International Application No. PCT/EP2018/054277, filed Feb. 21, 2018, 5 pages.
Written Opinion of the International Searching Authority dated Oct. 29, 2018, issued in corresponding International Application No. PCT/EP2018/054277, filed Feb. 21, 2018, 6 pages.
International Preliminary Report on Patentability dated Aug. 27, 2020, issued in corresponding International Application No. PCT/EP2018/054277, filed Feb. 21, 2018, 1 page.

* cited by examiner

SYSTEM AND METHOD FOR POLISHING CAPSULES

TECHNICAL FIELD

This invention relates to a system and method for polishing capsules.

BACKGROUND

A capsule is a medicine intended to be swallowed orally which consists of a hard, hollow shell containing an active substance.

Such capsules are usually produced in the pharmaceutical industry. In the process of producing a capsule, two parts of a hard shell are joined together to trap an active substance and thus form the medicine in a common edible form. During this step, it is not uncommon for undesirable powder to remain stuck to the outer surface of the shell, for example by electrostatic effect.

Therefore, the process of producing a capsule usually comprises a step consisting of removing this powder adhered to the outer surface of the shell. This step is called "polishing a capsule".

This particular step of the production process of a capsule is usually achieved by exploiting mechanical effects to remove the above-mentioned powder. These mechanical effects are produced using a prior art system for polishing capsules, which comprises an inlet;

an outlet;

a wall arranged around an axis;

a brush located at least partially inside the wall and comprising bristles arranged around the axis so as to form a helical conveyor ramp for the capsules from the inlet to the outlet;

each of the bristles comprising a free end facing an inner face of the wall; and a mechanical unit arranged to generate a rotational movement of the brush around the axis to convey the capsules from the inlet to the outlet.

The brush used in this polishing system is a helical brush. The rotational movement of the brush around the axis allows to drive the capsules from the inlet to the outlet.

A defect of this polishing system is the poor quality of the brushing and polishing of the capsules. In addition, this system does not usually allow a line vacuum after use because some capsules get stuck episodically in the bristles of the brush or in other parts of the polishing system. This regularly results in painful disassembly and cleaning of the various parts of the polishing system in order to remove these capsules. This disassembly and this cleaning are also a clear source of waste of time.

SUMMARY

A first object of this invention is to provide a polishing system for polishing capsules allowing a better polishing of the capsules and a better line vacuum after use.

For this purpose, the invention provides a system for polishing capsules comprising:

an inlet;

an outlet;

a wall arranged around an axis extending from the inlet to the outlet;

a brush located at least partially inside the wall and comprising bristles arranged around said axis so as to form a helical conveying ramp for said capsules from said inlet to said outlet;

each of said bristles comprising a free end facing an inner face of said wall;

a mechanical unit arranged to generate a rotational movement of said brush around said axis to convey said capsules from said inlet to said outlet;

characterised in that:

a distance between the axis and the free end of a first bristle of the brush, and a distance between the axis and the free end of a second bristle of the brush differ by at least 2 mm; and, preferably the system further comprises at least one protrusion at the inner face of the wall and arranged to bend at least some of the bristles of the brush during the rotational movement of the brush around the axis.

The system for polishing capsules proposed by the invention is particularly advantageous. It allows a fast and efficient polishing of a large number of capsules.

In particular, the distinctive features of the polishing system according to the invention allow better polishing of the capsules and better line vacuum after use.

Indeed, as the bristles of the brush are arranged around the axis so as to form a helical conveying ramp, the capsules are conveyed on the lateral side of a part of the bristles of the brush of the system for polishing capsules according to the invention. Since the different free ends of the bristles of the brush are not all at the same distance from the axis, the capsules are capable of being supported by brush bristles, the free ends of which are further from the axis and of being in contact with the free ends of the brush bristles closer to the axis, or vice versa. The system according to the invention therefore induces a possible contact between the free end of at least one bristle and the capsules. However, the free ends of the bristles constitute the most brushing side of the brush. It follows that the polishing quality of the capsules conveyed on a brush of a system according to the invention will therefore be higher than that obtained by using a brush in which all the ends of the bristles are at the same distance from the axis and in which the capsules rest exclusively on the lightly brushing lateral side of the bristles of the brush during their conveyance.

It is preferred that the system further comprises at least one protrusion at the inner face of the wall and arranged to bend at least some of the bristles of the brush during the rotational movement of the brush around the axis. The rotating bristles thus bend against the at least one protrusion in such a way as to induce disturbances in the trajectory of the potential capsules resting on these at least some bristles during their conveyance. This is particularly interesting because during the rotation movement of the brush around the axis, the capsules are subjected to a centrifugal force, and therefore, they remain particularly in contact with the inner face of the wall during their conveyance.

The disturbances due to the protrusion induce an additional force to the centrifugal force. Consequently, a trajectory thus disturbed moves the capsules away from the inner face and closer to the axis, inducing a possible contact between the free end of at least one bristle and the capsules. The at least one protrusion thus advantageously increases the polishing effect of the capsules obtained with the system according to the invention. In general, the at least one protrusion also makes it possible to increase the turbulence experienced by the capsules on the brush during the rotational movement.

In addition, the capsules which would potentially be trapped between the bristles of the brush are able to be released when the at least some bristles bend due to the arrangement of the at least one protrusion. Indeed, when some bristles bend, others remain in their position, which increases the spaces between the bristles and allows the announced release. Thus, a better line vacuum is obtained thanks to the system according to the invention in the sense that the number of capsules that are not conveyed from the inlet to the outlet is very strongly reduced, or even preferably zero. In particular, the disassembly and cleaning of the system for polishing capsules according to the invention in order to remove capsules stuck therein will be few in number, which saves time and money for the user of the system.

Preferably, the bristles comprise a plurality of bristles whose free ends are at a first distance from the axis and a plurality of other bristles which are at a second distance from the axis, the two distances differing by at least 2 mm. Preferably, the first bristle belongs to the plurality of bristles and the second bristle belongs to the other plurality of other bristles.

Thus, advantageously, the capsules polishing quality is further improved.

Preferably, the above-mentioned space of at least 2 mm for the system according to the invention corresponds to a space larger than a diameter of one of the capsules, of a size determined preferably with a margin of error of about 10%, so that this capsule can rest on the side of a certain bristle while being in contact with the free end of a certain other bristle whose distance to the axis is at least 2 mm smaller than the distance of the free end of the certain bristle to the axis. In this case preferably the certain bristle is the first bristle and the certain other bristle is the second bristle.

Preferably, the figure of at least 2 mm as the difference of two distances of two ends of two separate bristles from the axis is at least 5 mm, more preferably at least 8 mm.

Preferably, the bristles comprise a plurality of bristles whose distance from the free ends to the axis is at least 8 mm smaller than the distance from the free ends of another plurality of bristles to the axis.

In the context of this document, "mechanical coupling" between two elements preferably refers to a fixed mechanical holding of the positions of these two elements relative to each other. In particular, a mechanical coupling between two elements includes the possibility of a direct fixing between these two elements, but also that of an indirect fixing by means of at least one intermediate element. However, a mechanical coupling between two elements does not preclude a possible relative movement between these two elements.

For the purpose of this document, the term "space" is used to refer to the three-dimensional ambient spatial space in which problems of conventional physics and mechanics are usually considered at our scale. This space is provided with the orthonormal co-ordinates system defined by the vectors $$(1,0,0),(0,1,0) \text{ and } (0,0,1)$$

corresponding to the three axes of the co-ordinates system respectively noted and represented by the letters X, Y and Z, within the framework of this document.

In the context of this document, the notion of "distance" between two coordinate points (x, y, z) and (x', y', z') in the space $\mathbb{R}^3$ is the positive real number defined by $$\sqrt{(x'-x)^2+(y'-y)^2+(z'-z)^2}.$$

This notion of distance corresponds to the notion of intuitive distance that the man of the street uses daily to make measurements at our scale. In the context of this document, the notion of "distance between two sets of points $E_1$ and $E_2$ in the space" is the smallest of the distances between a point in the set $E_1$ and a point in the set $E_2$. In particular, the "distance between two objects in the space" is the smallest distance between two points of these two objects.

For the purpose of this document, the "inside" of a hollow three-dimensional object is, preferably, the space enclosed within the concave surface defined by the object itself. For the purpose of this document, "an inner face" of such an object is a collection of points of the object that belong to the edge of its inside.

For the purpose of this document, the "outer surface" of a three-dimensional object is, preferably, the surface of the object that can be seen by an observer outside the object when the object is considered in isolation. In particular, the outer surface of an object consists of those points on the edge of the complementary of the object in space which do not belong to any possible inner face of the object.

For the purpose of this document, a "wall" of a three-dimensional object preferably refers to a shell of the object comprising its outer surface. Unlike the outer surface of the object, the wall is likely to have a strictly positive thickness.

For the purpose of this document, a "trajectory" of a point in the space in motion can be a curve described by the movement of that point in the space. For the purpose of this document, a "trajectory of a capsule" in motion in the space is defined by the trajectory of the centre of gravity of the capsule.

For the purpose of this document, a "cylindrical" object corresponds to an object that is cylindrical in shape. A "cylinder" is an infinite, regular surface of the space, symmetrically arranged around an axis and any cross-section orthogonal to the axis defines a circle of predetermined radius. The latter is referred to as the "radius of the cylinder" for the purpose of this document. The designation of a cylinder shape for an object does not imply that the object itself is a cylinder. The adjective "cylindrical" essentially refers to a global shape of the object without excluding that the object is of a certain thickness, or that its shape differs locally from that of a cylinder, for example, by comprising at least one protrusion and/or opening.

For the purpose of this document, an "ellipse" is the location of the points in space whose sum of the distances to two predetermined fixed points is constant. In particular, a circle is an ellipse. An ellipse comprises two perpendicular axes: a major axis passing through the two predetermined fixed points and a minor axis passing through the middle of the straight line segment between these two fixed points. A "half ellipse" is a half of an ellipse shared by one of its axes.

For the purpose of this document, a "helicoid" is preferably a surface of the space supported by a helix and an axis. It is obtained, for example, by rotating a half straight line or a straight line segment around an axis, the rotation being accompanied by a translation of the half straight line or straight line segment along that axis. For example, a helicoid inscribed in a cylinder of radius $R_2$ supported by the axis Z=(0,0,1) in the space can be given by the surface consisting of the points with coordinates (x, y, z) satisfying the equations $$\begin{cases} x = r\cos(\theta) \\ y = r\sin(\theta) \quad \text{with } r \in ]R_1, R_2[ \; et \quad \theta \in ]\theta_1, \theta_2[, \\ z = a\,\theta \end{cases} \qquad (*)$$

the parameters $a \in \mathbb{R} \setminus \{0\}$, $0 \leq R_1 < R_2$ et $\theta_1, \theta_2 \in \mathbb{R}$ being set. In this case, and for the purpose of this document, the number $2\pi a$ is called "helicoid pitch", the number $|a\theta_1 - a\theta_2|$ is called "helicoid length" and the numbers $R_1$ and $R_2$ are called respectively "inner radius" and "outer radius" of the helicoid. The above-mentioned half straight line or straight line segment is then an open straight line segment of length $R_2 - R_1$. For the purpose of this document, the helicoid defined by the equations (*) is an example of a "circular helicoid supported by the axis Z, with a pitch $2\pi/a$, a length $|a\theta_1 - a\theta_2|$, an inner radius $R_1$ and an outer radius $R_2$". More generally, if A designates any axis in the space, a "circular helicoid" supported by the axis A, of given pitch, length, inner and outer radii, can be given, for example, by the helicoid obtained by rotational movement bringing the axis Z on the axis A to the circular helicoid supported by the axis Z, of same pitch, length, inner and outer radii.

For the purpose of this document, a "helical" object is preferably a helicoid-shaped object. The designation of a helicoid shape for an object does not imply that the object itself is a helicoid. By the adjective "helical", it is essentially a global shape of the object without excluding that the object is of a certain thickness, or that its shape differs locally from that of a helicoid, for example, by comprising at least one protrusion and/or opening.

For the purpose of this document, a "bristle" of a brush refers, for example, to a fibre, filament or thread that is attached to a mount of the brush. A bristle of a brush preferably comprises two ends: a "fixed end", e.g. at a point on the mount of the brush; and a "free end". The latter term refers to an end that is not fixed to a point in space. In particular, when the fixed end is stable at one point in space, the free end of a bristle is able to move in space. A "length of a bristle" of a brush is the distance between its fixed end and its free end. The "side part of a bristle" of a brush is a part of the bristle not comprising its ends.

For the purpose of this document, a "helical brush" is, for example, a brush, each bristle of which is essentially arranged along a half straight line or a straight line segment capable of generating a helicoid by rotation and translation around an axis. In particular, in the case of an overall circular helicoid shape with an inner radius $R_1$ and an outer radius $R_2$, each bristle of a helical brush is preferably and substantially arranged radially between a cylinder of radius $R_1$ and a cylinder of radius $R_2$, in such a way that its fixed end is fixed at a point on the cylinder of radius $R_1$ or its inside, and its free end is in contact with a point on the cylinder of radius $R_2$. Several layers of bristles can thus be superimposed on circular helicoids of the same pitch supported by a common axis so as to give a bristle thickness to the brush. In this case, the "helical brush pitch" corresponds to the pitch of one of these circular helicoids.

For the purpose of this document, as defined in the prior art, the step in the production of a capsule by removing powder adhered to an outer surface of the shell is referred to as "polishing" the capsule. This term is equivalent to "cleaning" and/or "dedusting" and/or "brushing" the capsule. In particular, for the purpose of this document, the terms "system for polishing capsules", "system for dedusting capsules", "system for cleaning capsules" and "system for brushing capsules" are equivalent and the terms "method for polishing capsules", "method for dedusting capsules", "method for cleaning capsules" and "method for brushing capsules" are equivalent.

For the purpose of this document, a "line vacuum" in a system for polishing capsules means that no capsules introduced into the polishing system become trapped in the bristles of the brush or other parts of the polishing system. In particular, a system for polishing capsules allowing a line vacuum after use is a system for polishing capsules in which all capsules are conveyed from the inlet to the outlet within a reasonable time, i.e. without having to operate the system when it contains only capsules trapped in the bristles of the brush or other parts of the polishing system.

Preferably the first bristle is capable of supporting at least some of said capsules, said free end of said second bristle is adapted into contact with said capsules and said protrusion is adapted to come into contact with said capsules so as to influence a trajectory of said capsules during the rotational movement of the brush.

For example, during the rotational movement of the brush around the axis, a lateral portion of the first bristle is adapted to support each of the capsules, the free end of the second bristle is adapted to contact transversely each of the capsules, and the protrusion is adapted to contact each of the capsules so as to modify a trajectory thereof.

Preferably, the at least one protrusion is mechanically coupled to the inner face of the wall.

Preferably, a thickness of the first bristle differs from a thickness of the second bristle. Preferably, a thickness of the bristles of the brush is between 0.05 mm and 0.5 mm. More preferentially, the bristles are 0.1 mm or 0.3 mm thick.

Preferably, the brush comprises several thousand of bristles of different lengths.

The brush of the system according to the invention is preferably a helical brush so that the arrangement of the brush bristles around the axis is such that the brush forms a conveyor ramp for the capsules from the inlet to the outlet.

Preferably, the axis corresponds essentially to the axis Z.

Preferably, the length of the brush along the axis is between 400 mm and 1000 mm.

Preferably, the length of the wall along the axis is between 500 mm and 1500 mm.

Preferably, the largest diameter of the brush, between the end of one bristle and the end of the opposite bristle on the helical ramp, is between 70 and 100 m, more preferably between 80 and 90 mm.

Preferably, the largest diameter of the inner face of the wall is between 60 and 110 mm, more preferably between 70 and 100 mm. More preferably, the largest diameter of the inner face of the wall is essentially equal to the largest diameter of the brush.

Preferably, the free end of a bristle of the bristles of the brush is touching lightly and/or in contact with the inner face of the wall. More preferentially, the free ends of many of the bristles of the brush are touching lightly and/or in contact with the inner face of the wall.

Advantageously, the system according to the invention can easily be arranged in a restricted space.

Preferably, the system according to the invention is mechanically coupled to a movable trolley.

Advantageously, the system according to the invention is easily manoeuvrable and transportable.

Preferably, the system according to the invention is composed of easily detachable and dismountable parts.

Advantageously, the system according to the invention is easily cleanable because it is easily disassembled into individual parts.

Preferably, the mechanical unit comprises a motor capable of generating the rotational movement.

Preferably, the system comprises a central part arranged symmetrically along the axis, inside the wall, and each of the bristles comprises an end fixed to this central part. Preferably, the mechanical unit generates a rotational movement of this central part around the axis so as to induce the rotational movement of the brush around the axis. Preferably, a shape of this central part corresponds to a shape of the inner face of the wall. Preferably, the largest diameter of this central part is between 40 mm and 60 mm.

Advantageously, the bristles of the brush are arranged around the axis so as to form a conveyor ramp for the capsules. Most of the capsules are therefore not able to penetrate the brush, between the bristles, of the system according to the invention, during the rotational movement. Advantageously, the line vacuum of the system according to the invention is therefore better. If one of the capsules nevertheless penetrates between the bristles of the brush, the presence of the at least one protrusion makes it possible to bend the at least some bristles, preferably all of the bristles, and thus to enlarge the space between these bristles so as to free the capsule. Preferably, the conveying ramp formed by the bristles of the brush is perfectly hermetic to the capsules.

Preferably, a capsule introduced into the inlet is conveyed to the outlet of the polishing system on the conveyor ramp in less than 25 seconds, more preferably in less than 20 seconds.

Advantageously, the polishing system according to the invention makes it possible to polish, brush and/or clean a large number of capsules in a very short time, efficiently, with better line vacuum.

Preferably, the at least one protrusion comprises a rigid element elongated along the axis so as to deflect the trajectories of the capsules during the rotational movement, and so as to bend the at least some bristles during the rotational movement.

However, the polishing system according to the invention is not limited to the case where the at least one protrusion comprises a comb or a side brush attached to the inner face of the wall. Such a comb or side brush preferably comprises bristles arranged along segments of straight lines parallel and orthogonal to the axis, so that a free end of such a bristle faces the axis.

Advantageously, as the centrifugal force drives the capsules against the wall during the rotational movement of the brush, in the case where the at least one protrusion comprises a comb or a side brush fixed to the inner face of the wall, the capsules are then in contact with at least one free end of a bristle of the side brush or of the comb, and the quality of their polishing is improved thereby.

According to a particular embodiment of the system for polishing capsules according to the invention, the bristles are substantially arranged along straight line segments orthogonal to the axis, so as to coincide with the straight line segments;

the straight line segments correspond to cross sections of circular helicoids supported by the axis, the cross sections being made in planes orthogonal to the axis;

the circular helicoids having the same pitch and the same inner radius;

an outer radius of a first one of the helicoids differing by at least 2 mm from an outer radius of a second one of the helicoids.

It can be recalled that the notion of circular helicoid is precisely defined in the preliminary part of this disclosure of the invention. In addition, it is known that a circular helicoid cross section orthogonal to the axis on which it is supported comprises only one segment of a straight line. A man of the street will be able to convince himself of this by setting a value for the variable θ in the equation (*).

According to this embodiment, the bristles are essentially arranged along a selection of such straight line segments. This characteristic makes it possible to understand the arrangement of the bristles around the axis. In addition, this embodiment of the invention guarantees such an arrangement of the bristles along circular helicoids of the same pitch and the same inner radius but with different outer radii. It follows that the fixed ends of the bristles of the system according to this embodiment are aligned at a predetermined distance from the axis, this distance being given by the inner radius of the helicoids, but that the free ends of the bristles are not all arranged at a same distance from the axis.

In particular, it follows that there are a first plurality of bristles, the free ends of which are at a first distance from the axis, corresponding to a first outer radius of a helicoid, and a second plurality of bristles, the free ends of which are at a second distance, which differs by at least 2 mm, preferably by at least 5 mm, more preferably by at least 8 mm, from the first distance, corresponding to a second outer radius of a helicoid. The first and second bristles are capable of arbitrarily belonging to one or other of these pluralities of bristles, the choice of the plurality of bristles being distinct for the first and second bristles.

Advantageously, this particular embodiment of the invention proposes bristles, the arrangement of which is essentially ordered precisely on circular helicoids, but also proposes bristles, the free ends of which are at different distances from the axis, while ordering bristles whose free ends are at the same distance from the axis as being arranged on cross sections of the same helicoid.

When they are conveyed over the bristles of the brush, and during the rotational movement, the capsules are preferably bearing on the lateral side of the longest bristles arranged along cross sections of a plurality of helicoids of the same maximum outer radius, these bristles preferably forming a helical conveying ramp. The capsules are also preferentially adapted to come into transverse contact with the free ends of shorter bristles arranged along cross sections of helicoids with outer radii smaller than the maximum outer radius. An improved polishing effect is then induced by such a helical brush according to this particular embodiment of the invention.

Preferably, the pitch of circular helicoids is between 40 mm and 60 mm, more preferably between 45 mm and 55 mm. Preferably, the pitch of circular helicoids is between 5 and 25 pitches.

Preferably, the circular helicoids have an inner radius between 30 mm and 65 mm, more preferably between 40 mm and 55 mm. Preferably, the circular helicoids have an outer radius between 45 mm and 75 mm, more preferably between 52 and 68 mm.

Preferably, there are a plurality of helicoids of helicoids having a smaller outer radius. The bristles arranged along the cross sections of a helicoid of this plurality of helicoids preferably have a smaller thickness than the other bristles. Preferably this thickness is 0.1 mm. Preferably, the thickness of the other bristles is 0.3 mm.

Preferably, there are a plurality of helicoids of the helicoids having a maximum outer radius at least 8 mm larger than the smallest outer radius, preferably at least 16 mm larger than the smallest outer radius.

According to a particular embodiment of the system for polishing capsules according to the invention, the free ends of the bristles included in a cross section of the brush along a plane comprising the axis are essentially arranged along four to twenty straight lines parallel to the axis, symmetrically aligned on the plane, on either side of the axis;

a distance between the axis and a first of the straight lines, and a distance between the axis and a second of the straight lines, differing by at least 2 mm.

The bristles of the brush according to this particular embodiment of the invention are arranged in the form of stair steps, a length of one step being at least 2 mm, preferably 8 mm, more preferably 16 mm, greater than a length of another step. A helical brush according to this embodiment of the invention is called a "multi-stage brush".

In this analogy, the edge of a step is determined by a straight line along which the free ends of bristles are aligned. The brush is preferably symmetrically arranged around the axis and is preferably helical. The straight lines given by the free ends of the bristles appearing during a cross section of the brush comprising the axis are therefore in an even number, symmetrically arranged on either side of the axis. The number of straight lines being limited, the bristles are necessarily aligned and ordered in such a way that several free ends of the bristles are on the same straight line. Preferably, the number of straight lines is between four and eight, more preferably, it is six, i.e. the free ends of the bristles are aligned in three different stages.

When they are conveyed over the bristles of the brush, and during the rotational movement, the capsules preferably rest on the longest helical step, i.e. on the lateral side of the bristles, the free ends of which are aligned on the two straight lines furthest from the axis, these bristles preferably forming a helical conveying ramp. The capsules are also preferably suitable for coming into transverse contact with the free ends of bristles forming a shorter step superimposed on the longer step. An improved polishing effect is then induced by such a brush according to this particular embodiment of the invention.

Preferably, the bristles are arranged in such a way that the longest step has a thickness of between 4 and 8 mm, this thickness being obtained by superimposing bristles so as to form the helical conveying ramp for the capsules.

Preferably, the first and second bristles have a free end in the cross section of the brush according to the plane comprising the axis, and the free end of the first bristle is arranged along the first straight line while the free end of the second bristle is arranged along the second straight line.

According to a particular embodiment of the system for polishing capsules according to the invention which is different from the previous particular embodiment, the free ends of the bristles included in a cross section of the brush along a plane comprising the axis are substantially arranged along:

- similar half ellipses of axes parallel and/or orthogonal to the axis; and
- along two straight lines parallel to the axis, symmetrically aligned in the plane on either side of the axis.

The bristles of the brush being arranged around the axis so as to form a helical ramp and the two parallel straight lines given by the free ends of the bristles appearing during a cross section of the brush comprising the axis being aligned symmetrically on either side of the axis, the helical ramp being supported on the axis. The number of half ellipses is then an even number, and the half ellipses are arranged on either side of the axis, the major axes and minor axes of the ellipses comprising the half ellipses and composing the axes of the half ellipses being parallel or orthogonal to the axis as mentioned above.

The number of straight lines being limited and the half-ellipses being all similar, preferably identical, it follows that the bristles are necessarily aligned and ordered so that several free ends of the bristles are on the same straight line or the same half-ellipses. Preferably, the number of half ellipses is between ten and thirty, more preferably between sixteen and twenty-four.

The ends of the half ellipses are preferably aligned with the straight lines. Half ellipses are preferably semi-circles.

When they are conveyed over the bristles of the brush, and during the rotational movement, the capsules preferentially rest on the lateral side of the bristles whose free ends are aligned on the two straight lines, the latter being preferentially further from the axis. These bristles alone preferably form a helical conveyor ramp capable of conveying the capsules from the inlet to the outlet. The movement of the capsules is then limited orthogonally to the axis by the cup formed by the free ends of the other bristles arranged along the half ellipses. In particular, the capsules are able to come into transverse contact with the free ends of these other bristles. An improved polishing effect is then induced by such a brush according to this particular embodiment of the invention.

Preferably, the adjacent bristles of the brush according to this embodiment, the free ends of which are aligned along a straight line included in a cross section of the brush according to a plane comprising the axis, forms a portion of a conveyor ramp for the capsules with a thickness of between 4 and 8 mm, this thickness being obtained by superimposing these adjacent bristles.

Preferably, the first and second bristles have a free end in the cross section of the brush according to the plane comprising the axis, and the free end of the first bristle is arranged along a straight line, while the free end of the second bristle is arranged along a half-ellipse.

According to a particular embodiment of the system for polishing capsules according to the invention which is distinct from the two previous particular embodiments, the free ends of the bristles included in a cross section of the brush in a plane comprising the axis are essentially arranged along:

- from two to twenty parallel straight lines, each of the straight lines intersecting the axis so as to form a first angle with the axis;
- from two to twenty parallel straight lines, each of the straight lines intersecting the axis so as to form a second angle with the axis;
- along two straight lines parallel to the axis, symmetrically aligned on the plane on either side of the axis.

Preferably, each of the straight lines forming a first angle with the axis is perpendicular to each of the straight lines forming a second angle with the axis.

Preferably, the number of straight lines forming a first angle with the axis is equal to the number of straight lines forming a second angle with the axis. More preferably, each of the straight lines forming a first angle with the axis is an orthogonal symmetry with respect to the axis of a straight line forming a second angle with the axis.

The advantages and preferred embodiment of the latter particular embodiment of the invention are deductive and assimilable to those mentioned for the two preceding embodiments.

All three of these embodiments of the invention describe different arrangements of the free ends of bristles of the brush of the polishing system according to the invention. The cross-sections of its brushes according to a plane comprising the axis reveal a succession of stair steps, cup or slopes surmounting a superposition of bristles of a maximum length constituting in themselves a helical conveyor ramp on which the capsules can be conveyed from the inlet to the outlet. The stair steps, cup or slopes of bristle ends are capable of being in contact with the capsules during their conveyance, while they rest on at least one bristle of maximum length. These three particular arrangements of bristles of the brush of the system according to the invention can be combined and many variations of such arrangements can be imagined without departing from the scope of the invention.

According to a particular embodiment of the system for polishing capsules according to the invention:

- the wall is cylindrical and symmetrically arranged along the axis;
- the wall comprises:
  - a lower cylindrical section comprising an inlet opening mechanically coupled to the inlet, and
  - an upper cylindrical section surmounting the lower cylindrical section and comprising an outlet opening mechanically coupled to the outlet;
- the inner face is cylindrical with a radius R;
- the system comprises a central cylindrical portion which is arranged symmetrically along the axis and which comprises a cylindrical outer surface of radius r<R;
- each of the bristles of the brush comprises an end fixed to the central cylindrical portion.

Preferably, each square centimeter of said cylindrical outer surface of said central cylindrical portion intersects a strictly positive number of said bristles.

Preferentially, the wall consists of the assembly of the lower cylindrical section, an intermediate cylindrical section surmounting the lower cylindrical section, and the upper cylindrical section, the latter surmounting the intermediate cylindrical section.

Advantageously, the cylindrical shape of the wall and of the central part is perfectly adapted to the use of a circular helical brush, the advantages and particular embodiments of which are abundantly commented above.

According to a particular embodiment of the system for polishing capsules according to the invention, the system also comprises a suction unit capable of removing dust from the inside of the wall.

These dusts comprise, in particular, undesirable powder adhered to the outer surface of the capsule shell of capsules introduced into the polishing system according to the invention.

Very advantageously, the polishing system according to this particular embodiment of the invention allows not only an efficient polishing of the capsules but also to evacuate the dust from the inside of the wall so that it does not clog the various elements of the system. This dust is preferably channelled through conduits from the inside of the wall to a receiving unit to accommodate the dust.

Different forthcoming embodiments of the invention detail the practical arrangement of the suction unit in relation to the inside of the wall and in relation to the wall. In particular, and preferably, the suction unit comprises a plurality of conduits connecting a space from the inside of the wall to a device capable of sucking up dust.

According to a particular embodiment of the system for polishing capsules according to the invention the wall comprises a plurality of sections mechanically coupled to each other, and the at least one protrusion comprises at least one protrusion section facing two of the sections, and fixed to at least one of the sections.

Preferably, each of the sections is isolated from the others by means of at least one seal. More preferably, the at least one seal is mechanically coupled to one end of the wall section. More preferably, the sections comprise a lower section, an upper section surmounting the lower section, and at least one intermediate section surmounting the lower section and surmounted by the upper section, each section comprising two ends, an upper end of the lower section being mechanically coupled to a lower end of the at least one intermediate section, the other end of the at least one intermediate section being mechanically coupled to only one of: another intermediate section, the upper section; each mechanical coupling between two sections by their respective ends involving a seal so as to isolate these two sections.

Advantageously, the polishing system according to this embodiment comprises different levels of confinement composed of the different sections. This allows easier handling and cleaning of the polishing system.

According to a particular embodiment of the system for polishing capsules according to the invention, the at least one protrusion comprises at least one protrusion portion fixed to an additional element configured to be mechanically coupled to the wall so as to at least locally conform to a shape of the wall;

the at least one protrusion portion being configured to enter a passage through the wall when the additional element is mechanically coupled to the wall, such that the at least one protrusion portion is arranged at least partially within the wall.

When the additional element conforms to the shape of the wall, the at least one protrusion portion penetrates from the outside of the wall to the inside of the wall through the passage. The at least one protrusion portion is also mechanically coupled to the inner face of the wall in such a way as to produce the technical advantages mentioned earlier in this text. When so arranged, the additional element and the at least one protrusion portion are preferentially elongated along the axis. Preferably at least two such protrusion portions elongated along the axis are fixed parallel to the additional element and capable of penetrating into two distinct passages of the wall when the additional element at least partially conforms to a shape of the wall. Preferably, the additional element is adapted to be in contact on an inner face with the outer surface of the wall.

Preferably, the additional element is coupled to the wall by means of fixing elements. These may comprise screws and/or bolts and/or welds.

Preferably, the system comprises at least three such additional elements elongated along the axis, arranged in a row along a portion of the wall elongated along the axis, a first additional element overhanging a second additional element, itself overhanging a third additional element, each additional element comprising at least one protrusion portion elongated along the axis, more preferably at least two portions of similar protrusions, elongated along the axis, and parallel.

Each such additional element is then preferentially coupled to a section of the wall when the wall comprises a plurality of sections as previously explained. In this case, when the at least one protrusion also comprises at least one protrusion section facing two of the sections, and attached to at least one of the sections, protrusions elongated along the axis are thus advantageously arranged end-to-end along a direction parallel to the axis, on the inner face of the wall, in such a way that all the bristles of the brush are capable of being bent during the rotational movement of the brush around the axis, and this by virtue of the fact that a protrusion exists along the inner face of the wall, thus facing the free ends of the bristles of the brush distributed over the entire length of the brush.

Advantageously, a better polishing and a better line vacuum is thus obtained thanks to the system according to this particular embodiment of the invention.

Preferably, the at least one protrusion portion and the additional element are at least partially made of a plastic material.

According to a particular embodiment of the preceding particular embodiment of the system for polishing capsules according to the invention:

the system further comprises a suction unit adapted to evacuate dust from the inside of the wall;

the wall comprises at least one hole with a diameter capable of being strictly smaller than a diameter of the capsules;

the additional element comprises a conduit, a first end of the conduit being mechanically coupled to a portion of the wall comprising the at least one hole, a second end of the conduit being mechanically coupled to the suction unit;

the conduit being arranged to transport the dust.

Advantageously, the at least one hole and the conduit allow the dust to be evacuated from the inside of the wall. The dust is sucked by the suction unit, and thereby passes through the at least one hole and the conduit, one end of which is mechanically coupled to a portion of the wall comprising the at least one hole, and a second end of which is mechanically coupled to the suction unit.

Advantageously, the at least one hole being of a diameter strictly smaller than a diameter of the capsules, the capsules are not adapted to be sucked through the at least one hole. In particular, only dust can be sucked through the at least one hole.

Preferably, said wall comprises a plurality of holes having a diameter strictly smaller than a diameter of a capsule. Preferentially, the plurality of holes is comprised in a portion of the wall elongated along the axis, the portion extending preferentially along the entire length of the wall with respect to the axis.

Preferably, the at least one protrusion portion is fixed to the additional element without obstructing an end and/or an opening of the conduit. Preferably, the additional element and the at least one protrusion portion is parallelepipedic and elongated along the axis, the conduit is cylindrical, openings at the ends of the conduit are circular, the end of the conduit mechanically coupled to a portion of the wall is made in an inner face of the additional element and the at least one protrusion portion is fixed to this inner face at a predetermined distance from the circular opening.

More preferably, the additional element comprises two such portions of parallelepipedal protrusions, elongated along the axis, fixed on the inner face, parallel to each other, at the same strictly positive distance from the end coupled to the wall, on either side of this end. Preferably, the system comprises at least three such additional elements elongated along the axis, arranged in a row along a portion of the wall elongated along the axis, a first additional element overhanging a second additional element, itself overhanging a third additional element, each additional element comprising a conduit and two protrusion portions as described above in this paragraph.

Advantageously, protrusion portions elongated along the axis are thus arranged end-to-end along a direction parallel to the axis, on the inner face of the wall, on either side of the ends of the conduits coupled to the wall, in such a way that all the bristles of the brush are capable of being bent during the rotational movement of the brush around the axis, thus allowing dust to be detached from the capsule shells, this dust being sucked through the holes of the wall and through the conduits mechanically coupled to the suction unit.

Advantageously, a better polishing and a better line vacuum is thus obtained thanks to the system according to this particular embodiment of the invention.

Advantageously, a better distribution of the pressure inside the wall, along the axis, is obtained thanks to a series of two, three or more conduits mechanically coupled to a portion of the wall comprising holes which do not allow the capsules to pass through, the ends of the conduits coupled to the wall being equidistant.

According to a particular embodiment of the preceding particular embodiment of the system for polishing capsules according to the invention, the latter further comprises at least one seal fixed to an inner face of the additional element, the at least one seal describing a curve on the inner face of the additional element, the curve being configured to locally conform to the shape of the wall, so as to surround an outer surface of the portion of the wall comprising the at least one hole, when the additional element is mechanically coupled to the wall.

Advantageously, this embodiment of the polishing system according to the invention allows a confinement of the portion of the wall with which the first end of the conduit is mechanically coupled, so as to guarantee a sealed suction of dust through the wall, through the at least one hole. This allows easier disassembly and cleaning of the polishing system.

Preferably, the curve described by the seal surrounds the at least one protrusion portion on the inner face of the additional element.

Preferably, for the embodiments comprising a plurality of additional elements, each such additional element is provided with such a seal on its inner face.

Preferably, when this particular embodiment is particularized in the case of a wall comprising a plurality of sections as described above, these sections are isolated by seals. Thus, lateral and end openings on the wall section are isolated by seals so as to facilitate cleaning and disassembly of the polishing system.

According to an embodiment of the system for polishing capsules according to the invention, the system further comprises:

a lower plate arranged perpendicularly to the axis, mechanically coupled to the wall and to a lower end section of the brush;

the lower end section of the brush being adapted to convey the capsules from the inlet to an upper section of the brush surmounting the lower end section of the brush during the rotational movement of the brush;

the upper section of the brush being adapted to convey the capsules from the lower end section of the brush to the outlet, during the rotational movement of the brush;

at least one lug at a surface of the plate bordering the inside of the wall, the lug being capable of driving at least one of the capsules from the plate to the lower end section of the brush during the rotational movement of the brush.

The plate is preferably mechanically fixed to a base of the wall. Both the wall and the plate are fixed during the rotational movement.

Advantageously, the system according to this embodiment of the invention allows a line vacuum after use.

Indeed, as described above, the at least one protrusion of the polishing system effectively contributes to evacuating possible capsules which would be stuck in the bristles of the brush during their conveyance. However, in spite of these protrusions, it cannot be excluded that a capsule, between its inlet into the polishing system and its effective conveyance on the conveyor ramp formed by the bristles of the brush in rotational movement around the axis, misses its passage between the inlet and the lower end section of the brush and does not fall under the brush, therefore under the conveyor ramp. Of course, this situation is rare and the system according to the invention is arranged so that this does not happen, but it nevertheless advantageously provides for this case.

In order to solve the technical problem of the evacuation of capsules which would be stuck at the base of the polishing system, under the brush, therefore under the conveyor ramp, the system according to a particular embodiment of the invention proposes a plate provided with a lug, the plate and the lug having the technical features mentioned above. When a capsule falls between the inlet and the lower end section of the brush, it is received by the plate. Therefore, advantageously, it is not lost. Then, as the brush is in rotational movement, it will carry the capsule on the plate, towards the lug, which has an advantageous position and an advantageous shape, traditionally known by a person skilled in the art. The movement of the rotating brush then allows the capsule pushed against the lug to acquire a trajectory partially along the axis and therefore to start again upwards, towards the lower end section of the brush, and therefore to be conveyed by the latter. In other words, the capsule bounces against the lug on the plate and is received by the brush in rotational movement. In this way, the capsules on the plate are conveyed on the conveyor ramp to the outlet and the polishing system according to this embodiment of the invention allows a line vacuum.

Advantageously, the plate equipped with the lug is very easy and inexpensive to design and place on a polishing system according to the invention.

Preferably, the lug is fixed to an upper surface of the plate.

Preferably, the plate comprises feet that can be inserted into a flange surmounting a base comprising the mechanical unit of the polishing system. The wall is preferably fixed to this base and the mechanical coupling between the plate and the wall is preferably made indirectly from this base. The wall and the plate are not driven in a rotational movement by the mechanical unit, unlike the brush.

According to a particular embodiment of the previous particular embodiment of the system for polishing capsules according to the invention:

- the system further comprises a suction unit capable of evacuating dust from the inside of the wall.
- the plate has at least one orifice with a diameter capable of being strictly smaller than the diameter of the capsules;
- the suction unit comprises a conduit mechanically coupled to the plate, the at least one orifice of the plate surmounting an opening of the conduit;
- the conduit being arranged to transport the dust.

Advantageously, the dusts are then sucked through the at least one orifice, by the suction unit, to the base of the polishing system according to this embodiment.

The system according to this embodiment of the invention is also provided with holes in the wall and several side conduits included in additional elements as described above, a good balance of the pressure from bottom to top, in the inside of the wall, is ensured, as well as an optimal evacuation of the dust.

According to a particular embodiment, the system for polishing capsules according to the invention, this system further comprises a logic unit connected to the mechanical unit and comprising an interface suitable for:

- communicating information to a human operator outside the system;
- receiving instructions from a human operator outside the system.

Advantageously, the connection between the logical unit and the mechanical unit allows these two units to communicate with each other by means of a wired or wireless connection. In particular, such a connection allows an exchange of data.

Advantageously, a human operator can view system information via the interface and send instructions to the logic unit via the interface to set or adapt operating parameters of the system contained in the information.

Preferably, the information that is communicated to a human operator comprises a speed of rotation of the brush around the axis. Preferably, the instructions received from a human operator include a speed of rotation of the brush around the axis, the speed being within a predetermined range. Preferably, the instructions which are received from a human operator comprise stopping or starting the system according to the invention.

This invention also provides a capsule production line comprising the system according to the invention.

Preferentially, this capsule production line comprises a capsule filling machines comprising an access for introducing raw material and an exit for discharging produced capsules, the exit being mechanically coupled to the inlet of the system according to the invention.

Typically, the current capsule filling machines have a relatively low exit. Advantageously, the inlet of the polishing system according to the invention can be arranged at the same height as the exit of a capsule filling machine to be coupled with the exit of a capsule filling machine within this capsule production line. In this case, the axis essentially corresponds to the axis Z and the outlet overhangs the inlet, the conveying ramp bringing the capsules from the bottom to the top.

Preferably, the capsule production line is configured to produce capsules in an automated way.

According to a particular embodiment of the polishing system capsules according to the invention, this system further comprises:

- an antistatic polymer tube mechanically coupled to the outlet and configured to convey the capsules from the outlet;
- a detection unit mechanically coupled to the tube and configured to detect metal poisoning of the capsules as they are conveyed through the tube.

Advantageously, this polishing system allows not only a polishing and cleaning of the capsules introduced by the inlet but also a detection of a possible metal intoxication of these capsules.

According to this embodiment of the invention, when it is in action, the capsules leave the conveying ramp formed by the brush inside the wall and are driven by the tube, the latter preferably comprising one end mechanically coupled to the outlet. The tube passes preferentially through the sensor.

The advantageous composition of the tube made of antistatic polymer allows an optimal sliding of the capsules potentially charged with static electricity.

The metal poisoned capsules are ejected from the tube through an way out, while the other capsules are ejected into an ejection box mechanically coupled to another end of the tube. This ejection box is preferentially grounded so as to remove conducted static electricity from the shell of the capsules.

The tube is preferably rigid. The coupling of the tube with the box and the outlet is done at its ends via a cutting system comprising a flexible sleeve as described in the European patent publication number EP2321564B1.

A second object of this invention is to provide a method of polishing capsules which allows both particularly fast and efficient polishing of capsules.

For this purpose, the invention provides a method of polishing capsules comprising the steps of:

(i) providing a system for polishing capsules according to the invention;

(ii) generating a rotational movement of the brush around the axis by means of the mechanical unit;

(iii) introducing the capsules into the system through the inlet;

(iv) conveying the capsules from the inlet to the outlet on the conveying ramp formed by the brush in rotational movement around the axis;

(v) discharging and collecting the capsules through the outlet.

All embodiments and all advantages of the system for polishing capsules according to the invention are transposed mutatis mutandis to this polishing method. In this sense, an application of the method according to the invention permits rapid and efficient polishing of a large number of capsules.

Preferably, the method of polishing capsules according to the invention is included in a capsule production method so as to produce and polish capsules in assembly-line.

BRIEF DESCRIPTION OF THE FIGURES

Other features and advantages of the invention will appear when reading the following detailed description, for the understanding of which reference is made to the figures annexed hereto, among which are the following.

The drawings of the figures are not to scale. Generally, similar elements are denoted by similar references in the figures. In the context of this document, identical or similar elements may have the same references.

Figure 1:
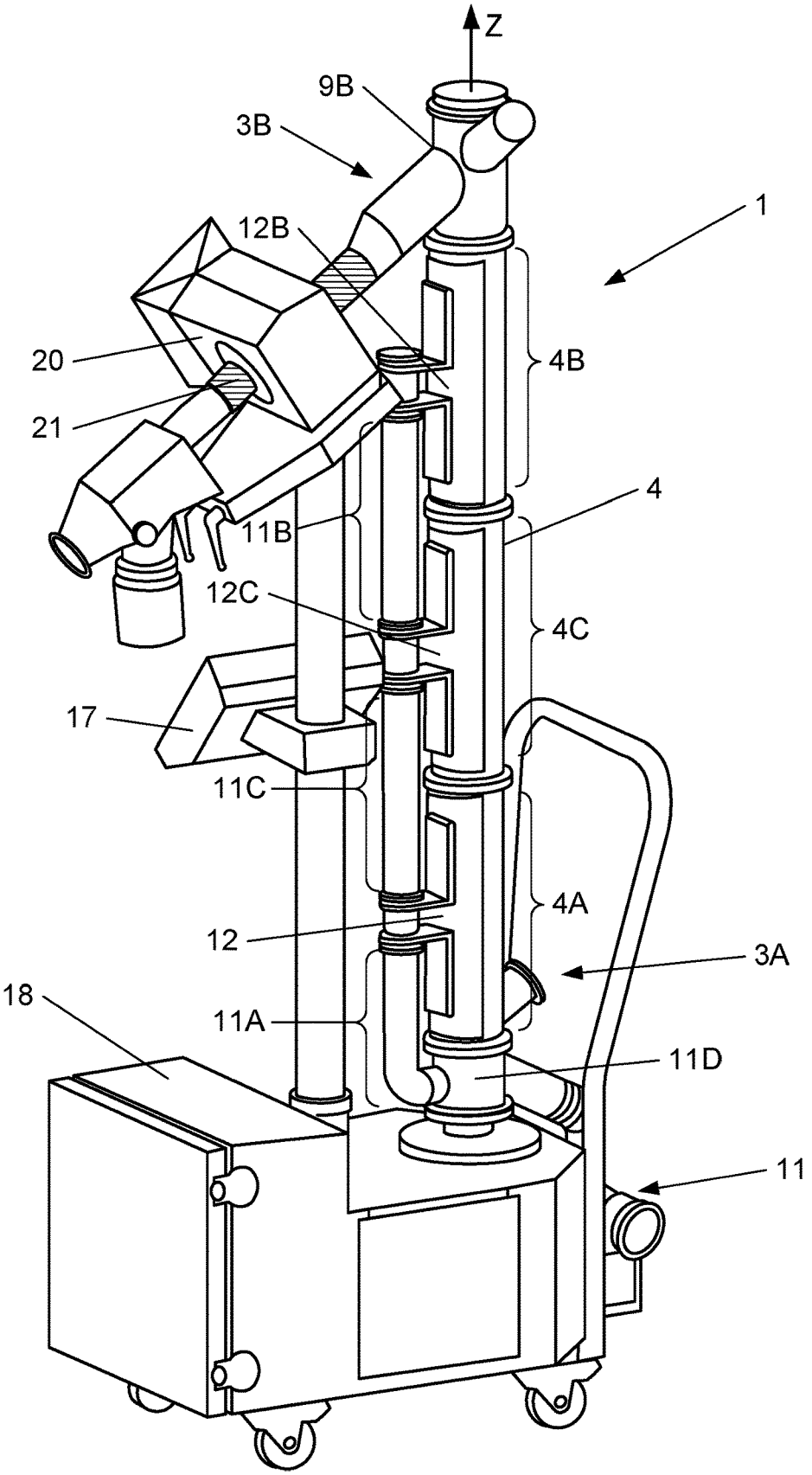
FIG. 1 illustrates a simplified three-dimensional overall schematic view of a system for polishing capsules according to an embodiment of the invention.

In addition, the presence of reference numbers in the drawings cannot be regarded as limiting, even where such numbers are indicated in the claims.

DETAILED DESCRIPTION

This part presents a detailed description of preferred embodiments of this invention. The latter is described with particular embodiments and references to figures, but the invention is not limited by them. In particular, the drawings or figures described below are only schematic and are not restrictive.

It should also be noted that the axis Z, the straight lines d, d', $d_1$, $d_2$, $d_3$, $d_4$, $d_5$, $d_6$, and the circle S are represented on some figures that follow for purely illustrative purposes in order to visualize different characteristics of embodiments of systems for polishing capsules. In particular, these abstract geometrical elements do not correspond to concrete material objects.

In the embodiments described, the axis of the system for polishing capsules according to the invention coincides with the axis Z=(0, 0, 1) of the co-ordinates system defined in the disclosure of the invention and the inlet is overhung by the outlet of the system according to the invention. These choices and this particular representation is in no way limiting the scope of the invention.

FIG. 1 illustrates a simplified three-dimensional overall schematic view of a system 1 for polishing capsules according to an embodiment of the invention.

The system 1 comprises an inlet 3A located at the bottom, an outlet 3B located at the top, and a cylindrical wall 4 symmetrically arranged along the axis Z. The wall is composed of three sections: a lower cylindrical section 4A, an intermediate cylindrical section 4C, and an upper cylindrical section 4B, mechanically coupled to each other from bottom to top along the axis Z. The section 4A comprises an inlet opening (9A, visible in FIG. 2) coupled to the inlet 3A and the section 4B comprises an outlet opening 9B coupled to the outlet 3B. Specifically, the inlet 3A and outlet 3B each comprise a conduit that fits into the respective inlet and outlet openings.

A helical brush is located in the inside of the wall. Since the representation in the FIG. 1 is a three-dimensional global view of a polishing system according to an embodiment of the invention by an observer, the helical brush is not represented through the wall. The figures will concentrate on the helical brush later.

Returning to the polishing system shown in FIG. 1. It comprises additional elements 12, 12C and 12B arranged from bottom to top in this order at the same length interval along the axis Z and respectively facing the centers of sections 4A, 4C and 4B of the wall 4. Each of the additional elements 12, 12C and 12B is coupled to the wall 4 via a conduit not shown in FIG. 1, one end of which is coupled with a portion of the wall comprising holes not shown in FIG. 1.

The additional elements allow mechanical coupling with a series of conduits 11A, 11C and 11B belonging to a suction unit 11. These conduits are arranged from bottom to top, in this order, along the axis Z, so as to form a single long conduit arranged along the axis Z, two conduits being coupled to each other by one of the additional elements. The conduit 11A faces a base of the system 1 and a lower half of the section 4A, the conduit 11C faces an upper half of the section 4A and a lower half of the section 4C, the conduit 11B faces an upper half of the section 4C and a lower half of the section 4B. The conduit 11A is attached to a bend and to another conduit 11D surmounted by the wall, communicating via at least one orifice with the inside of the wall.

The conduits 11A-D of the suction unit connect four zones bounding the inside of the wall communicating with the inside of the wall via the above-mentioned holes and orifices, so as to extract dust from the inside of the wall and evacuate it through conduits 11A-D. The dusts typically comprise powder adhered to the capsules.

The system 1 preferably comprises an antistatic polymer tube 21 mechanically coupled to the outlet 3B by a flexible sleeve, the coupling being as described in European patent publication number EP2321564B1, so as to convey the capsules without any static electricity present on the shells thereof interfering with them. The tube 21 passes through a metal poisoning detection unit 20 of the capsules, so as to detect any capsules possibly poisoned by metals. A discharge for such capsules is also provided at the outlet of the tube 21.

The system 1 is arranged on a trolley 18 comprising an enclosure in which technical and electronic infrastructures are arranged, including a possible dust collector coupled to the suction unit 11. The whole system can thus be easily moved and positioned, particularly at the outlet of a capsule filling machine.

The trolley may also comprise a logic unit with an interface 17 shown in FIG. 1. Thus various parameters of the system 1 such as the speed of rotation of the helical brush around the axis Z can be communicated to a human operator or controlled by a human operator.

Figure 2:
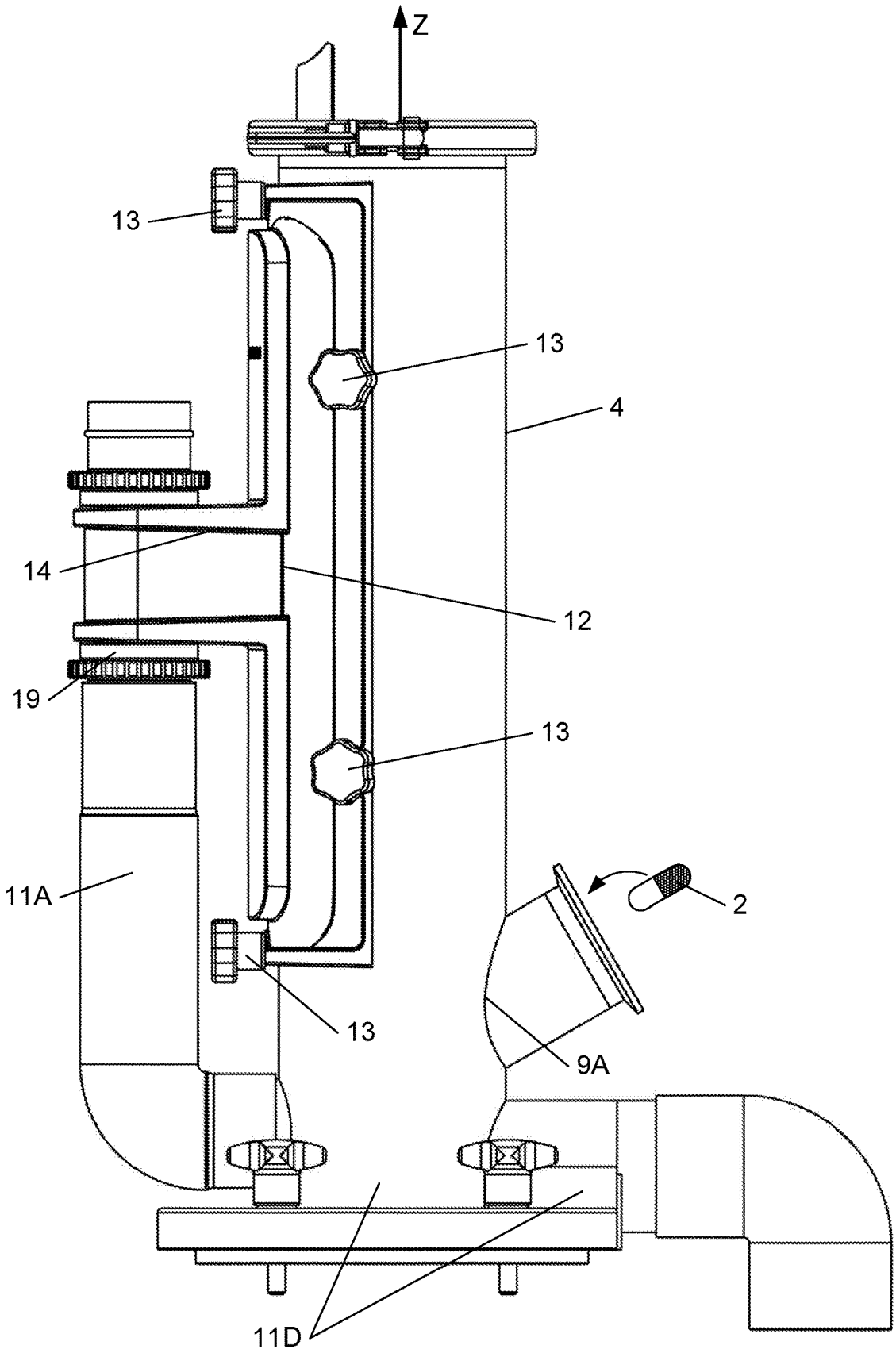
FIG. 2 illustrates a schematic view of a lower portion of a system for polishing capsules according to an embodiment of the invention.

The FIG. 2 shows a schematic view of a lower portion of a system 1 for polishing capsules 2 according to an embodiment of the invention. It is a further detailed representation of conduits 11A and 11D and the lower cylindrical section of the wall 4 described above.

The inlet opening 9A and the inlet 3A make it possible to introduce the capsules 2 into the system, and to allow them to be conveyed by the helical brush not shown and located inside the wall 4.

The connection between the additional element 12 and the conduit 11A is made by means of connections 19. The additional element 12 is mechanically coupled to the wall 4 with fixing elements 13 so as to conform to the shape of a portion of the wall 4 comprising at least one hole to allow the dust sucked from the inside of the wall by the suction unit 11 to escape.

Similar representations and descriptions are valid for the other additional elements 12C and 12B, as well as for the conduits 11B and 11C.

Figure 3:
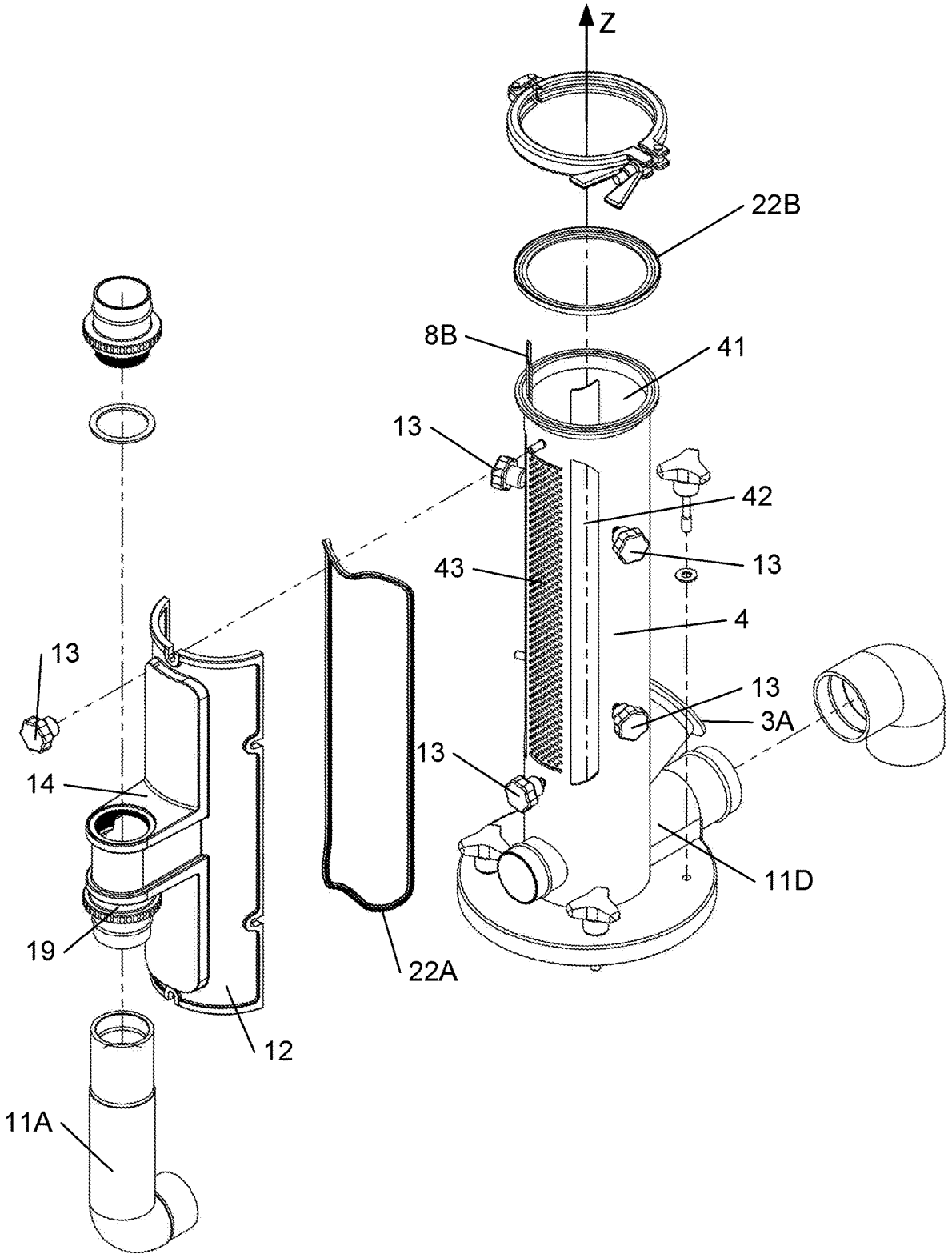
FIG. 3 illustrates a three-dimensional schematic view of an assembly of parts which make up the lower portion of the system for polishing capsules according to the embodiment of the invention illustrated in FIG. 2.

The FIG. 3 shows a three-dimensional schematic view of an assembly of parts which make up the lower portion of the system 1 for polishing capsules 2 according to the embodiment of the invention which is illustrated in FIG. 2.

This view constitutes a plan enabling a person skilled in the art to easily reconstruct the system according to the invention. This view reveals the holes 43 in a portion of the wall 4 coupled to one end of the conduit 14 of the additional element 12. Thus, the holes allow the passage of dust which is sucked from the inside of the wall by the suction unit 11, this dust being channelled through the conduit 14 and the conduits 11A and 11D.

The additional element 12 is configured to be mechanically coupled to the portion of the wall 4 comprising the holes 43. In order to conform to the cylindrical shape of the wall 4, the additional element is elongated along the axis Z and in the form of a cylindrical portion. A curved seal 22A is included between one face of the additional element and the portion of the wall 4 comprising the holes 43, so as to isolate this portion and contribute to the sealing of the system 1. Another seal 22B is coupled to an upper end of the wall portion so as to also contribute to a sectional sealing of the system 1. This seal allows for easier cleaning and disassembly of the system 1. It also allows the system to include a capsule cleaning unit (not shown) using a liquid.

The at least one protrusion comprises two portions of elongated protrusions along the axis, not visible in this figure, which are fixed to an inner face of the additional element so as to penetrate two elongated passages 42 through the wall 4, these being arranged on either side of the holes 43. When the additional element is coupled to the wall 4 with the fixing elements 13, the protrusion portions protrude through the passages 42 inside the wall 4 so as to constitute protrusions of the inner face 41 of the wall along the entire cylindrical section of the wall 4 shown. Thus, the at least one protrusion is capable of bending at least some of the bristles of the brush inside the wall 4. The at least one protrusion also comprises a protrusion section 8B fixed to the portion of the wall 4 so as to constitute an extension of a protrusion portion along the axis Z, and to obtain better draining along the entire axis Z, and not just along the protrusion portions.

These considerations extend without limitation to the other additional elements and to other cylindrical sections of the wall 4. Furthermore, the number of such elements or sections is not limiting and a higher or lower number may be chosen without departing from the scope of the invention.

The at least one protrusion is described as comprising protrusion sections 8B arranged straddling two cylindrical sections of the wall, aligned along the axis Z, as well as portions of elongated protrusions fixed to additional elements 12 conforming a portion of the wall 4 provided with holes. However, this latter production of protrusion portions is not limiting in the case where the protrusions are fixed to the inner face 41 of the wall 4 without having to be coupled to the latter by means of an additional element. In addition, the at least one protrusion may combine both sections of protrusions fixed to the inner face 41 of the wall and protrusions sections fixed to at least one additional element 12 mechanically coupled to the wall 4.

Figure 4:
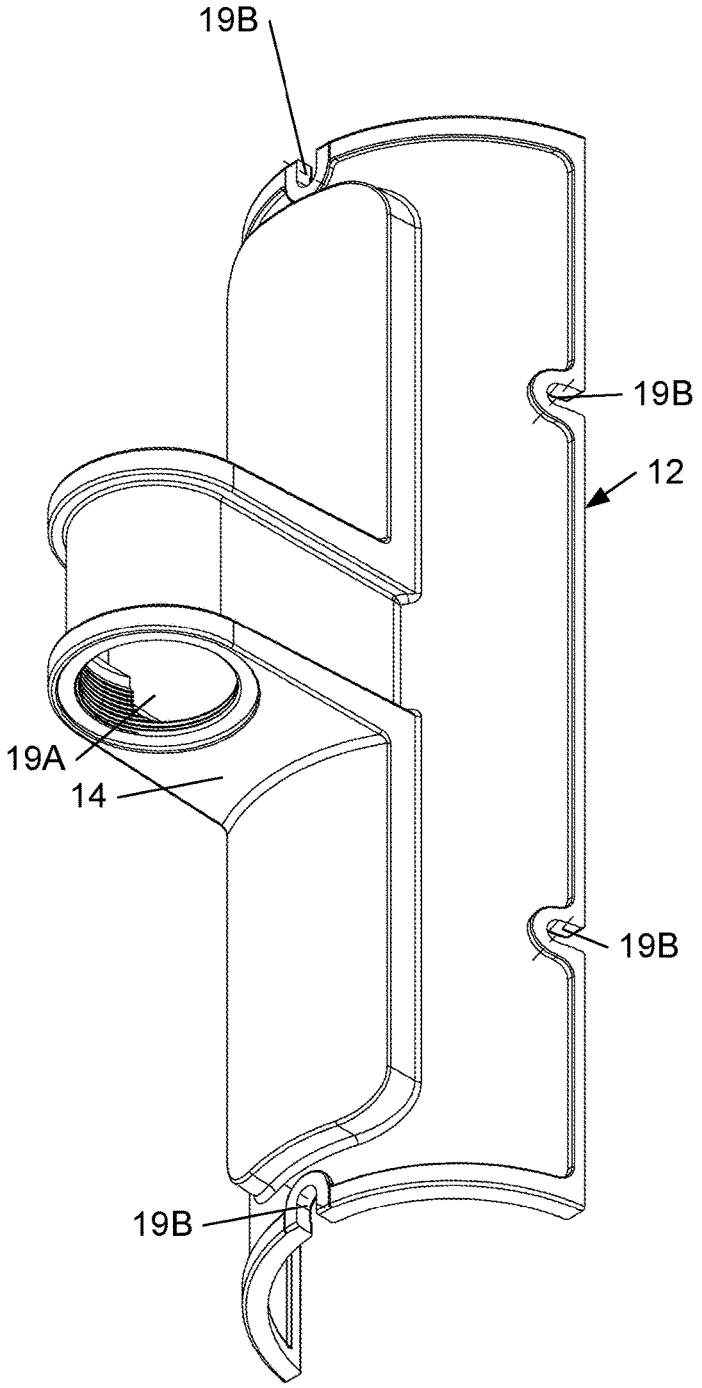
FIG. 4 illustrates a three-dimensional schematic view of an additional element of a system for polishing capsules according to an embodiment of the invention.

FIG. 4 shows a three-dimensional schematic view of an additional element 12 of a system 1 for polishing capsules 2 according to an embodiment of the invention.

The connection 19A allows the conduits 11A and 11C illustrated in FIG. 1 to be connected to each other, and also to be connected to the conduit 14 of the additional element 12, one end of which faces the holes 43 of the wall 4. The dust is thus easily extracted from the inside of the wall 4 through holes 43 and channelled through the conduit 14 and conduits 11A-D.

The connections 19B allow the additional element 12 to be mechanically coupled to a portion of the wall 4 by means of the fixing elements 13.

Figure 5:
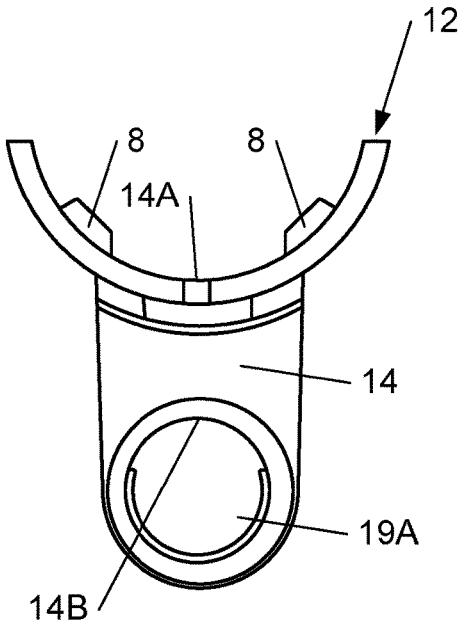
FIG. 5 shows a schematic top view of the additional element of the system for polishing capsules according to the embodiment of the invention illustrated in FIG. 4.

FIG. 5 shows a schematic view of the top of the additional element 12 of the system 1 for polishing capsules 2 according to the embodiment of the invention illustrated in FIG. 4.

This figure is the first finally allowing to visualize precisely the position of the two elongated protrusions of the at least one protrusion 8 which are fixed on a cylindrical inner face of the additional element 12.

The ends 14A and 14B of the conduit 14 are also visible in FIG. 5. The end 14A is mechanically coupled to the portion of the wall 4 containing the holes 43, and the end 14B is mechanically coupled to the conduits 11A and 11C, and therefore to the suction unit 11.

Figure 6A:
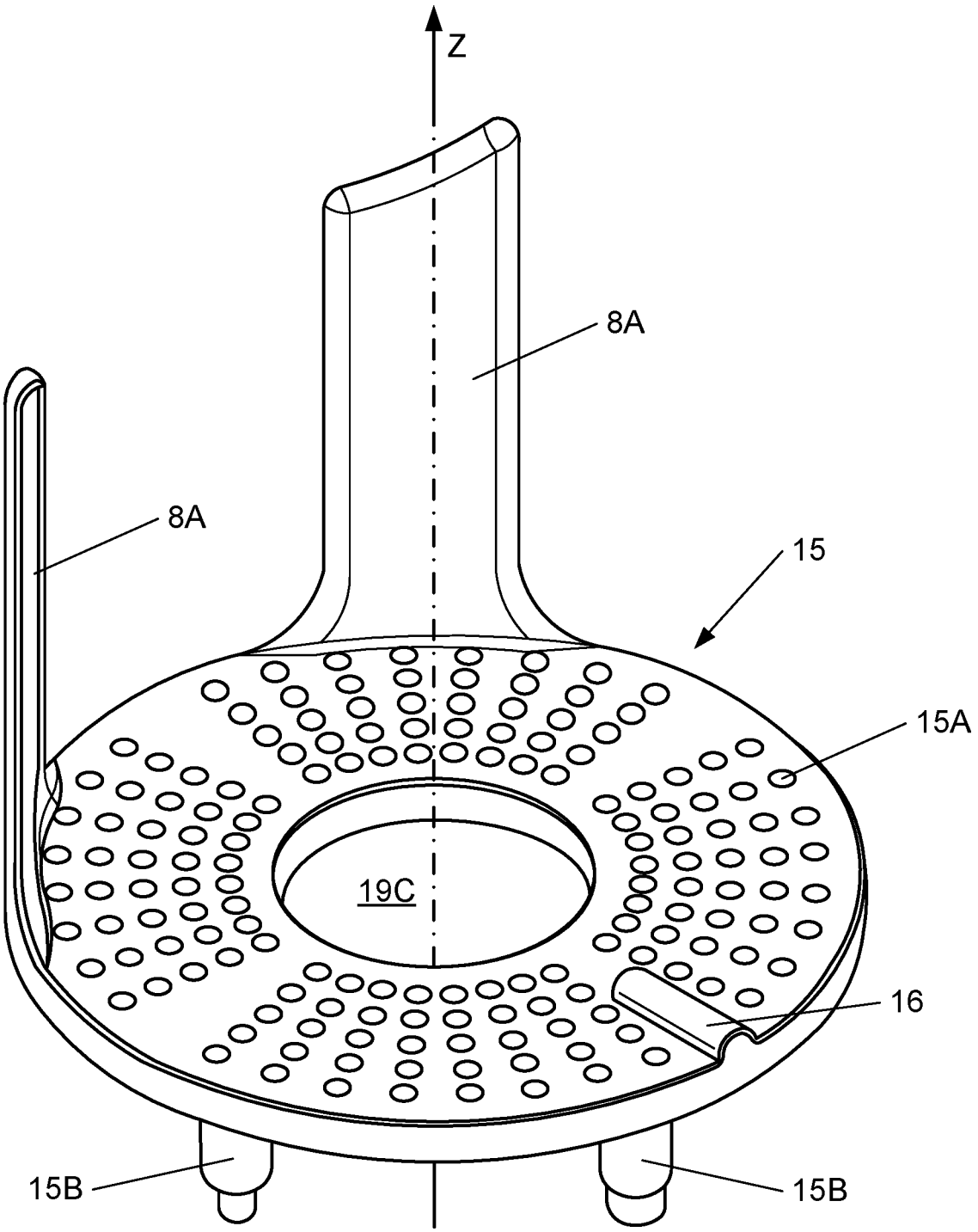
FIG. 6A illustrates a schematic three-dimensional view of a plate and a lug of a system for polishing capsules according to an embodiment of the invention.
Figure 6B:
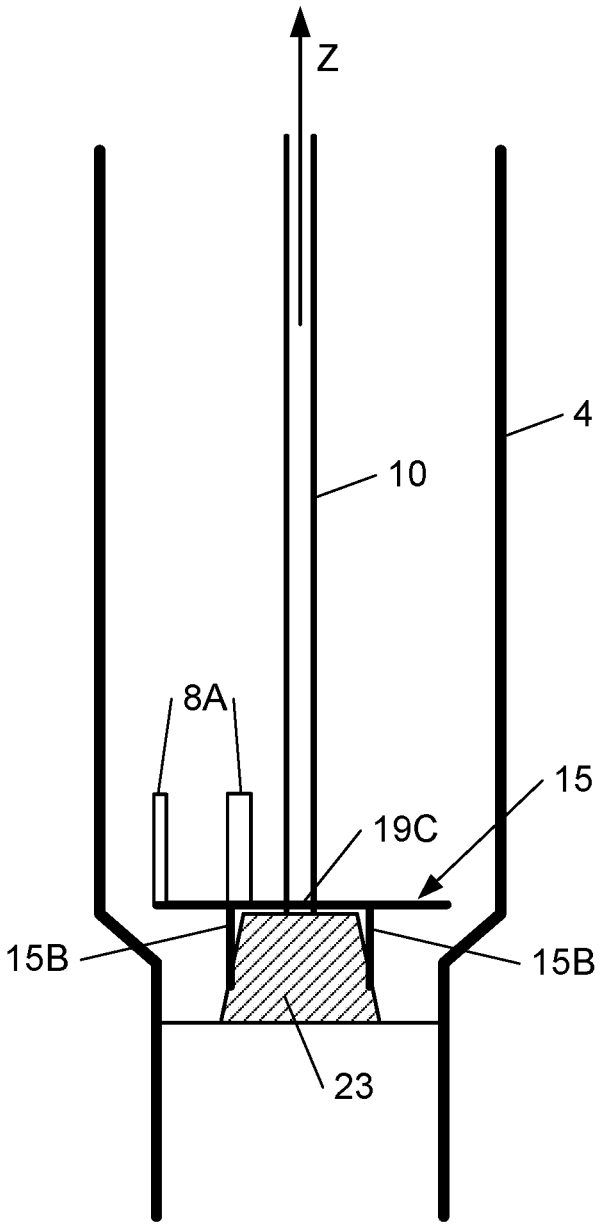
FIG. 6B illustrates a two-dimensional schematic view of the placement of a plate similar to that shown in FIG. 6A in a system for polishing capsules according to an embodiment of the invention.

FIG. 6A shows a three-dimensional schematic view of a plate 15 and a lug 16 of a system 1 for polishing capsules 2 according to an embodiment of the invention, while FIG. 6B shows a two-dimensional schematic view of the placement of such plate 15 in this system 1 for polishing capsules 2.

The plate 15 is annular in shape and comprises orifices 15A surmounting an opening of the conduit 11D, allowing a complementary connection from the inside of the wall 4 with the suction unit 11 so as to evacuate the dust through the conduit 11D.

The lug 16 is typically half cylinder shaped to allow the capsules 2 that would be under the conveyor ramp to bounce off the lug 16, under the impulse of the rotating movement of the brush, so as to be driven from the plate 15 to a lower end section of the brush.

An opening 19C in the center of the plate provides a housing for a central cylindrical part 10 arranged symmetrically around the axis Z, to which part the ends of the bristles are fixed. The central cylindrical part 10 is in rotational movement, driving the bristles of the brush in this movement, while the plate 15 and the wall 4 are fixed. The plate comprises feet 15B which are inserted in a flange 23 fixed to a base to which the wall 4 is coupled, the base comprising the mechanical unit of the system 1.

The at least one protrusion comprises beginnings of protrusions 8A surmounting two portions of the lateral end of the plate 15. These beginnings of protrusions face the lower end section of the brush and are arranged to bend at least some of the bristles of the lower end section of the brush during the rotational movement. These beginnings of protrusions are in contact with the two elongated protrusions shown in FIG. 5 when all the parts of the polishing system 1 are interlocked.

Figure 7:
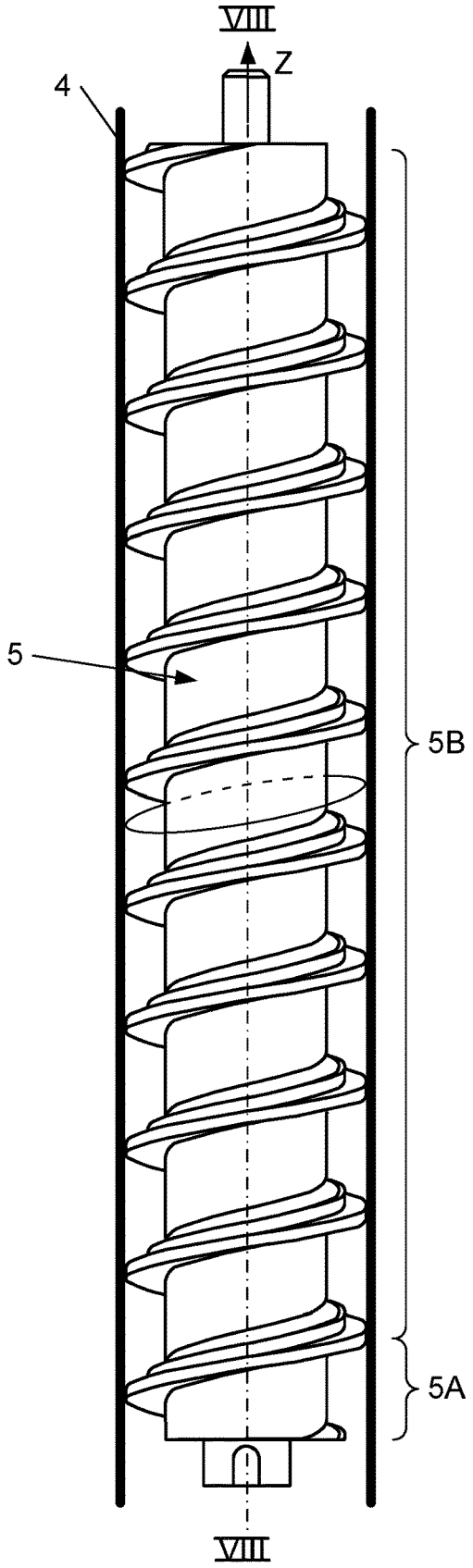
FIG. 7 shows a three-dimensional schematic view of a brush of a system for polishing capsules according to an embodiment of the invention.
Figure 9:
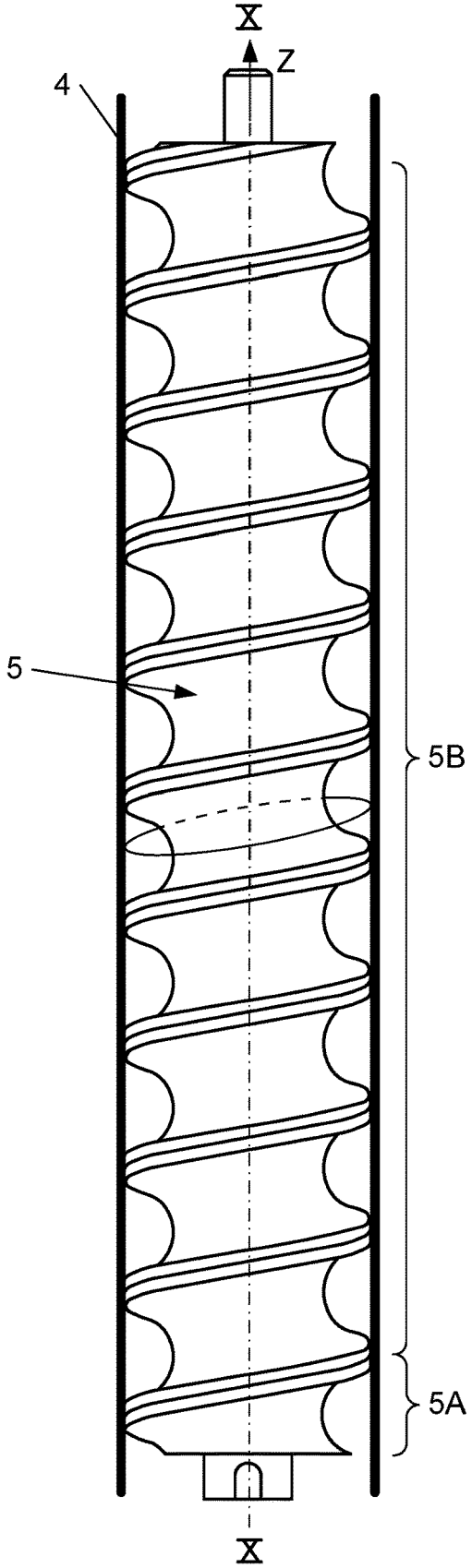
FIG. 9 illustrates a three-dimensional schematic view of a brush of a system for polishing capsules according to an embodiment of the invention.

FIGS. 7 and 9 illustrate two schematic views of helical brushes 5 of a system 1 for polishing capsules 2 according to two distinct embodiments of the invention.

These two representations are neither exhaustive nor restrictive of the embodiments of the brush 5 according to the invention.

The brush comprises the lower end section 5A discussed above and an upper section 5B essentially constituting the remainder of the brush 5. The lower end section 5A conveys the capsules from the inlet to the upper section 5B, and the upper section 5B conveys the capsules from the lower end section 5A to the outlet 5B.

The brush 5 is arranged inside the wall 4 so that a plurality of free ends of the longest bristles touch lightly or are in contact with the wall 4, thereby forming a conveying ramp for the capsules 2 from the inlet 3A to the outlet 3B. The helical brush is supported on the axis Z and is arranged symmetrically to this axis and to the wall 4.

Figure 8:
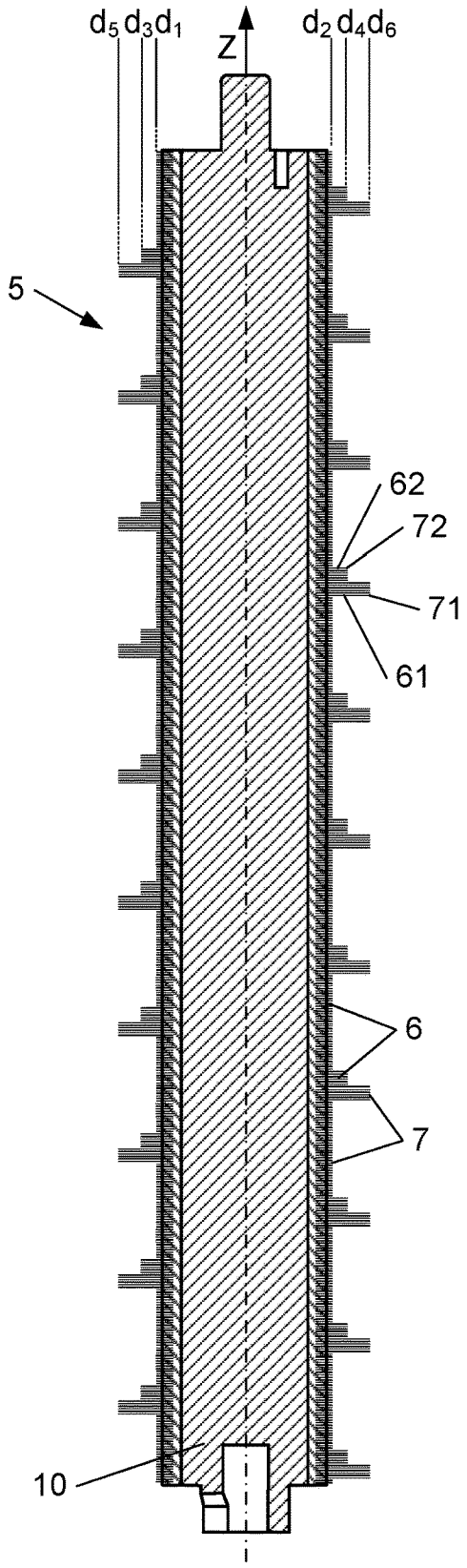
FIG. 8 illustrates a planar transverse cross-section of the brush of the system for polishing capsules according to the embodiment of the invention illustrated in FIG. 7.

FIG. 8 shows a flat cross section of the helical brush 5 of the system 1 for polishing capsules 2 according to the embodiment of the invention illustrated in FIG. 7.

In particular, FIG. 8 illustrates the bristles 6 of the brush 5 and the free end 7 of each bristle 6. Each bristle 6 comprises one end fixed to a central cylindrical part 10 already commented on above. A first bristle 61 comprises a free end 71 at a distance more than 2 mm further from the axis Z than the free end 72 of a second bristle 62. The free end 71 is arranged along the straight line d4, while the free end 62 is arranged along the straight line d6, these two straight lines being parallel to the axis Z and spaced more than 2 mm apart.

The free ends 7 of the bristles 6 are aligned on parallel straight lines $d_1$, $d_2$, $d_3$, $d_4$, $d_5$ and $d_6$, arranged symmetrically on either side of the axis Z. Thus, $d_1$, $d_3$ and $d_5$ are respectively the orthogonal symmetries of $d_2$, $d_4$ and $d_6$ with respect to the axis Z. The ends of the bristles 7 thus have a profile in the form of a vaulted stair step, as detailed in the disclosure of this invention.

Figure 10:
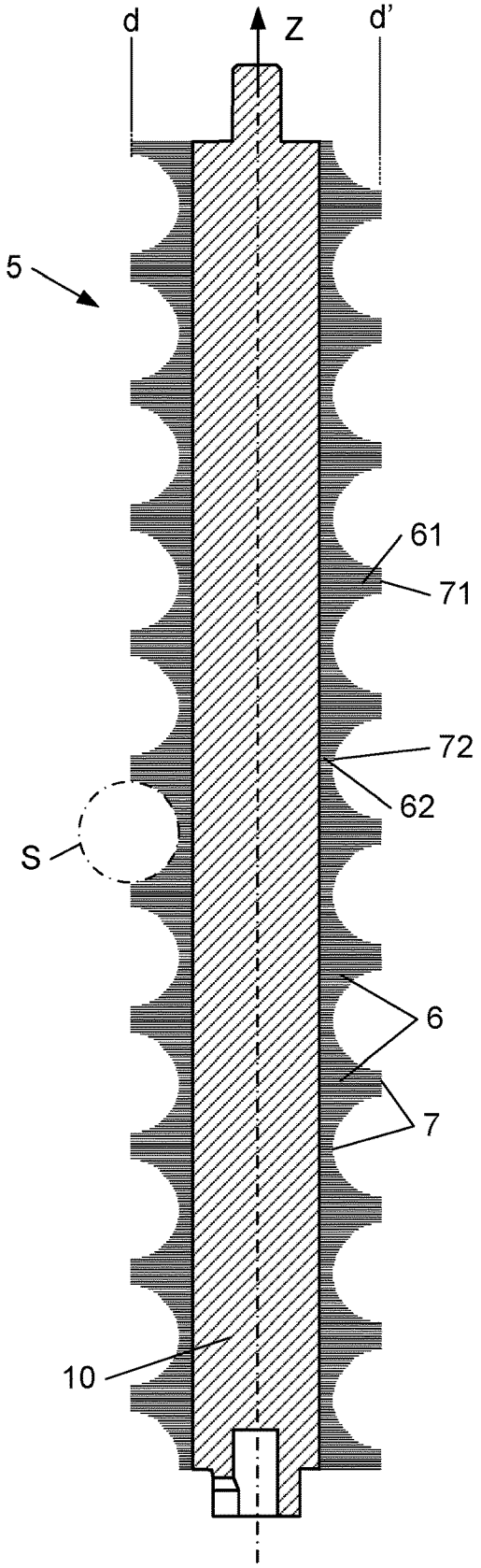
FIG. 10 shows a planar transverse cross-section of the brush of the system for polishing capsules according to the embodiment of the invention illustrated in FIG. 9.

FIG. 10 shows a flat cross-section of the helical brush 5 of the system 1 for polishing capsules 2 according to the embodiment of the invention illustrated in FIG. 9.

In particular, FIG. 10 illustrates the individual bristles 6 of the brush 5 as well as the free end 7 of each bristle 6. Each bristle 6 comprises one end fixed to the central cylindrical part 10. A first bristle 61 has a free end 71 at a distance more than 2 mm further from the axis Z than the free end 72 of a second bristle 62. The free end 71 is arranged along the straight line d', while the free end 62 is arranged along a circle similar to S with its centre on the straight line d'.

In general, the free ends 7 of the bristles 6 are arranged along two straight lines d and d' and along semi-circles based on the circle S, the centers of which are exclusively aligned at the same distance on two straight lines d and d'. The ends of the bristles 7 thus have a cup-shaped profile which is praised and detailed in the disclosure of this invention.

In summary, this invention relates to a system 1 and a method for polishing capsules 2. The system 1 according to the invention comprises a brush 5 located at least partially inside a wall 4 arranged around an axis Z. The brush comprises bristles 6 arranged around the axis Z so as to form a helical conveying ramp for the capsules 2. The lengths of the bristles 6 of the brush 5 are substantially distinct and a protrusion 8, 8A, 8B is mechanically coupled to the wall 4 to bend at least some of the bristles 6 of the brush 5 when the latter is in rotational motion around the axis Z. The method according to the invention consists essentially of putting the above-mentioned system into practice.

This invention has been described in relation to specific embodiments, which are purely illustrative and should not be regarded as restrictive.

Generally speaking, it shall be obvious to the person skilled in the art that this invention is not limited to the examples illustrated and/or described above. The invention comprises each of the new features described herein as a whole, as well as all combinations thereof. For example, it is possible, while remaining within the scope of the invention, for the system to comprise bristles arranged as illustrated in FIG. 8 and bristles arranged as illustrated in FIG. 10.

For the purpose of this document, the terms "first", "second", "third", and "fourth" are used only to differentiate between the different elements and do not imply any order between them. The use of the verbs "to include", "to comprise", "to consist" or any other variant, as well as their conjugations, can in no way exclude the presence of elements other than those mentioned. The use of the indefinite article "an", "a", or the definite article "the", to introduce an element does not exclude the presence of a plurality of such elements.

The invention claimed is:

1. A system for polishing capsules comprising:

an inlet;

an outlet;

a wall arranged around an axis (Z) extending from said inlet to said outlet;

a brush located at least partially inside the wall and comprising bristles arranged around said axis (Z) to form a helical conveying ramp for said capsules, from said inlet to said outlet, each of said bristles comprising a free end facing an inner face of said wall; and a mechanical unit configured to generate a rotational movement of said brush about said axis (Z) to convey said capsules from said inlet to said outlet;

wherein:

a distance between said axis (Z) and said free end of a first bristle of said brush, and a distance between said axis (Z) and said free end of a second bristle of said brush differ by at least 2 mm;

said system comprising at least one protrusion;

at said inner face of said wall, and arranged to bend at least some of said bristles of said brush during said rotational movement of said brush around said axis (Z).

2. The system according to claim 1, wherein:

the first bristle configured to support said capsules;

said free end of said second bristle is configured to contact said capsules; and said protrusion is configured to contact said capsules to influence a trajectory of said capsules during said rotational movement of said brush around said axis (Z).

3. The system according to claim 1, wherein said bristles are arranged along straight line segments orthogonal to said axis (Z) to coincide with said straight line segments;

said straight line segments corresponding to cross sections of circular helicoids supported by said axis (Z), said cross sections being made along planes orthogonal to said axis (Z);

said circular helicoids having the same pitch and the same inner radius;

an outer radius of a first one of said helicoids differing by at least 2 mm from an outer radius of a second one of said helicoids.

4. The system according to claim 1, wherein said free ends of said bristles included in a cross section of said brush along a plane comprising said axis (Z) are arranged along four to twenty straight lines parallel to said axis (Z), symmetrically aligned on said plane, on either side of said axis (Z);

a distance between said axis (Z) and a first one of said straight lines, and a distance between said axis (Z) and a second one of said straight lines, differing by at least 2 mm.

5. The system according to claim 1, wherein said free ends of said bristles included in a cross section of said brush along a plane comprising said axis are substantially arranged along:

similar half ellipses of axes parallel and/or orthogonal to said axis (Z); and along two straight lines parallel to said axis (Z), symmetrically aligned on said plane, on either side of said axis (Z).

6. The system according to claim 1, wherein:

said wall is cylindrical and symmetrically arranged along said axis (Z);

said wall comprises:

a lower cylindrical section comprising an inlet opening mechanically coupled to said inlet, and an upper cylindrical section surmounting said lower cylindrical section and comprising an outlet opening mechanically coupled to said outlet (3B);

said inner face is cylindrical of radius R;

said system further comprising a central cylindrical portion arranged symmetrically along said axis (Z) and comprising a cylindrical outer surface of radius r <R;

each of said bristles of said brush comprising an end fixed to said central cylindrical portion.

7. The system according to claim 1, wherein said wall comprises a plurality of sections mechanically coupled to each other, and in that said at least one protrusion comprises at least one protrusion section facing two of said sections, and fixed to at least one of said sections.

8. The system according to claim 1, wherein in that said at least one protrusion comprises at least one protrusion portion fixed to an additional element configured to be mechanically coupled to said wall, so as to at least locally conform to a shape of said wall;

said at least one protrusion portion being configured to enter a passage passing through said wall when said additional element is mechanically coupled to said wall, so that said at least one protrusion portion is arranged at least partially inside said wall.

9. The system according to claim 8, wherein:

the system comprises a suction unit adapted to evacuate dust from the inside of said wall;

said wall comprises at least one hole with a diameter capable of being strictly smaller than a diameter of said capsules;

said additional element comprises a conduit, a first end of said conduit being mechanically coupled to a portion of said wall comprising said at least one hole, a second end of said conduit being mechanically coupled to said suction unit;

said conduit being arranged to transport said dust.

10. The system according to claim 9, wherein it further comprises at least one seal fixed to an inner face of said additional element, said at least one seal describing a curve on said inner face of said additional element, said curve being configured to locally conform to said shape of said wall, so as to surround an outer surface of said portion of said wall comprising said at least one hole, when said additional element is mechanically coupled to said wall.

11. The system according to claim 1, wherein it further comprises:

a lower plate arranged perpendicularly to said axis (Z), mechanically coupled to said wall and to a lower end section of said brush;

said lower end section of said brush being configured to convey said capsules from said inlet to an upper section of said brush surmounting said lower end section of said brush during said rotational movement of said brush;

said upper section of said brush being configured to convey said capsules from said lower end section of said brush to said outlet during said rotational movement of said brush;

at least one lug at a surface of said plate bordering the inside of said wall, said lug being capable of driving at least one of said capsules from said plate to said lower end section of said brush, during said rotational movement of said brush.

12. The system according to claim 11, wherein:

the system further comprises a suction unit configured to evacuate dust from the inside of said wall;

said plate comprises at least one orifice having a diameter smaller than a diameter of said capsules; and said suction unit comprises a conduit mechanically coupled to said plate, said at least one orifice of said plate surmounting an opening of said conduit;

said conduit being configured to transport said dust.

13. The system according to claim 1, further comprising:

an antistatic polymer tube mechanically coupled to said outlet and configured to convey said capsules from said outlet;

a detection unit mechanically coupled to said tube and configured to detect metal intoxication of said capsules as said capsules are conveyed through said tube.

14. A method of polishing capsules comprising the steps of:

(i) providing a system for polishing said capsules according claim 1;

(ii) generating a rotational movement of said brush around said axis (Z) with said mechanical unit;

(iii) introducing said capsules into said system through said inlet;

(iv) conveying said capsules from said inlet to said outlet on said conveying ramp formed by said brush in rotational movement around said axis (Z);

(v) discharging and collecting said capsules through said outlet.

15. A production line for capsules comprising the system for polishing said capsules according to claim 1.

* * * * *